US006188771B1

(12) United States Patent
Horrall

(10) Patent No.: US 6,188,771 B1
(45) Date of Patent: Feb. 13, 2001

(54) PERSONAL SOUND MASKING SYSTEM

(75) Inventor: Thomas R. Horrall, Harvard, MA (US)

(73) Assignee: Acentech, Inc., Cambridge, MA (US)

( * ) Notice: Under 35 U.S.C. 154(b), the term of this patent shall be extended for 0 days.

(21) Appl. No.: 09/266,186

(22) Filed: Mar. 10, 1999

Related U.S. Application Data

(60) Provisional application No. 60/077,535, filed on Mar. 11, 1998.

(51) Int. Cl.[7] ..... H04R 3/02

(52) U.S. Cl. ..... 381/73.1; 381/94.3

(58) Field of Search ..... 381/73.1, 71.1, 381/71.2, 71.4, 71.6, 71.13, 71.14, 94.1, 94.2, 94.3, 94.7, FOR 123, FOR 124; 281/71.11, 71.12

(56) References Cited

U.S. PATENT DOCUMENTS

| | | | | |
|---|---|---|---|---|
| 4,654,871 | * | 3/1987 | Chapplin et al. | 381/72 |
| 4,736,431 | * | 4/1988 | Allie et al. | 381/71.8 |
| 5,590,206 | * | 12/1996 | An et al. | 381/71.13 |
| 5,805,714 | * | 9/1998 | Kasama et al. | 381/71.8 |
| 5,812,682 | * | 9/1998 | Ross et al. | 381/71.12 |

FOREIGN PATENT DOCUMENTS

| | | | | |
|---|---|---|---|---|
| 5-108083 | * | 4/1993 | (JP) | 381/73.1 |
| 6-175666 | * | 6/1994 | (JP) | 381/73.1 |

* cited by examiner

*Primary Examiner*—Forester W. Isen
*Assistant Examiner*—Xu Mai
(74) *Attorney, Agent, or Firm*—Weingarten, Schurgin, Gagnebin & Hayes LLP

(57) ABSTRACT

A personal sound masking system for use in an individual workspace provides an optimized acoustic background environment by delivering a sound masking signal that is specifically matched to the individual user's location and physical relationship to other nearby offices. The sound masking system employs multiple loudspeakers and multiple mutually incoherent channels in order to obtain a desired degree of diffuseness. A control module includes an erasable programmable read-only memory (EPROM) that stores data representing a number of samples of a masking signal segment, addressing logic that accesses the samples in the memory sequentially and repetitively to generate different series of data values each representing a different masking signal, digital to analog converters that convert the series of samples into analog masking signals, and power amplification circuitry that amplifies the analog masking signals to levels suitable for driving the loudspeakers. The sound masking system also includes a user-accessible volume control to enable the user to adjust the sound level to achieve optimum sound masking in his or her individual workspace.

9 Claims, 5 Drawing Sheets

PERSONAL SOUND MASKING SYSTEM

CROSS REFERENCE TO RELATED APPLICATIONS

This application claims priority under 35 U.S.C. §119(e) of U.S. provisional patent application No. 60/077,535, filed Mar. 11, 1998, entitled "Personal Sound Masking System", the entire disclosure of which is hereby incorporated by reference.

STATEMENT REGARDING FEDERALLY SPONSORED RESEARCH OR DEVELOPMENT

Not Applicable

BACKGROUND OF THE INVENTION

It is well known that freedom from distraction is an important consideration for workers satisfaction with their office environment. In a conventional enclosed office with full height partitions and doors, any speech sound intruding from outside the office is attenuated or inhibited by the noise reduction (NR) qualities of the wall and ceiling construction. Residual speech sound actually entering the office is normally masked or covered up by even very low levels of background noise, such as from the building heating or ventilating system. Under normal circumstances, the resulting speech audibility is sufficiently low that the office worker is unable to understand more than an occasional word or sentence from outside, and is therefore not distracted by the presence of colleagues' speech. In fact, it was shown more than 35 years ago that a standardized objective measure of speech intelligibility called the articulation index, or AI, could be used to reliably predict most people's satisfaction with their freedom from distraction in the office. "Perfect" intelligibility corresponds to an AI of 1.0, while "perfect" privacy corresponds to an AI of 0.0. Generally, office workers are satisfied with their privacy conditions if the AI of intruding speech is 0.20 or less, a range referred to as "normal privacy".

In recent years, the open plan type of office design has become increasingly popular due to its obvious flexibility and communication advantages. In contrast to conventional closed offices, the open plan design has only partial height partitions and open doorways, and unwanted speech readily transmits from a talker to unintended listeners in adjacent offices. Limited acoustical measures can be employed to reduce the level of the resulting speech that is transmitted. Highly sound absorptive ceilings reflect less speech, and higher partitions diffract less sound energy over their tops. Additionally, doorways are placed so that no direct line of sight or sound transmission exists from office to office, and the interiors of offices are treated with sound absorptive panels. Nevertheless, even in an acoustically well designed open office, the sound level of intruding speech is substantially greater than in most enclosed offices. In order to obtain the normal privacy goal of 0.20 AI, acousticians know that the level of background sound in the open office must be raised, usually by electronic sound masking systems. Indeed, a considerable proportion of larger contemporary open offices use electronic sound masking systems, sometimes called "white sound" systems. However, few smaller offices use such systems due to prohibitive costs.

Conventional sound masking systems typically comprise four main components; an electronic random noise generator, an equalizer or spectrum shaper, a power amplifier, and a network of loudspeakers distributed throughout the office. The equalizer adjusts the spectrum to compensate for the frequency dependent acoustical filtering characteristics of the ceiling and plenum or air space above and to obtain the spectrum shape desired by the designer. The power amplifier raises the signal voltage to permit distribution to the loudspeakers without unacceptable loss in the network lines. The generator, equalizer, and power amplifier are typically located at a central location connected to the loudspeaker distribution network. A typical system uses loudspeakers serving about 100–200 square feet each (i.e. placed on 10' to 14' centers); the loudspeakers are usually concealed above an acoustical tile ceiling in the plenum space. In most cases, the plenum above the ceiling is an air-return plenum so that the loudspeaker network cable must be enclosed in metal conduit or use special plenum-rated cable in order to meet fire code requirements.

The goal of any sound masking system is to mask the intruding speech with a bland, characterless but continuous type of sound that does not call attention to itself. The ideal masking sound fades into the background, transmitting no obvious information. The quality of the masking sound is subjectively similar to the natural random air turbulence noise generated by air movement in a well-designed heating and ventilating system. The overall shape of the masking spectrum is of paramount importance if the goal of unobtrusiveness is to be met. If it has any readily identifiable or unnatural characteristics such as "rumble," "hiss," or tones, or if it exhibits obvious temporal variations of any type, it readily becomes a source of annoyance itself. However, if the sound has a sufficiently neutral, unobtrusive spectrum of the right shape, it can be raised, without becoming objectionable, to a sound level or volume nearly equal to that of the intruding speech itself, effectively masking it.

Although a distributed, ceiling mounted sound masking system has numerous advantages, such a system has significant disadvantages that interfere with the effectiveness of the system at the level of the individual office worker. For example, mechanical system ducts and other physical obstructions, as well as acoustical variations in the above-ceiling plenum and ceiling components such as vented light fixtures and air return grilles, pose significant challenges to the designer in achieving adequately uniform spectral quality. In many installations, cavity resonances in the plenum occur and cannot be completely ameliorated by equalization or other techniques. As a consequence, the acoustical spectrum obtainable at any one office worker location may be substantially compromised compared to the ideal spectrum desirable at his or her particular location. This non-ideal spectrum and spatial variation throughout the office places an effective upper limit on the effectiveness of the masking system.

Obtaining the correct level or volume of the masking sound also is critical. The volume of sound needed may be relatively low if the intervening office construction, such as airtight full height walls, provides high NR, but it must be relatively high in level if the construction NR is compromised by partial-height intervening partitions or acoustically poor design or materials. Even in an acoustically reasonably well designed open office, the level of masking noise necessary to meet privacy goals may be judged uncomfortable by some individuals, especially those with certain hearing impairments. Some systems use volume controls on each masking loudspeaker to permit their adjustment for good spatial uniformity. Even with this costly measure, variations in level of 3–6 dB throughout an office are typical. This amount of variation typically corresponds to differences in AI of 0.1 to 0.2 and sentence intelligibility differences of more than 80% at different locations throughout the office. Such variations are clearly undesirable. Additionally, masking noise may not be desired in larger conference rooms or other communication spaces sharing ceiling plenums with masked areas, and it is impossible for the designer to fully satisfy both requirements.

Subjective spatial quality is a third important attribute of sound masking systems. The masking sound, like most other natural sources of random noise, must be subjectively diffuse in quality in order to be judged unobtrusive. Naturally generated air noise from an HVAC system typically is radiated by many spatially separated turbulent eddies generated at the system terminal devices or diffusers. This spatial distribution imparts a desirable diffuse and natural quality to the sound. In contrast, even if a masking system provides an ideal spectrum shape and sound level, its quality will be unpleasantly "canned" or colored subjectively if it is radiated from a single loudspeaker or location. A multiplicity of spatially separated loudspeakers radiating the sound in a reverberant (sound reflective) plenum normally is essential in order to provide this diffuse quality of sound. With some non-reflective ceiling materials and fireproofing materials used in plenums, it is necessary to resort to two or more channels radiating different (incoherent) sound from adjacent loudspeakers in order to obtain a limited degree of diffuseness. Some contemporary masking systems use such techniques, adding significantly to their installation complexity and cost. Despite careful consideration and design, the degree of diffuseness typically obtained is further limited by the economically dictated need to place many of the ceiling loudspeakers on the same signal distribution channel.

Finally, intentional lack of any user accessible controls is a requirement of conventional masking system design. Because the background sound affects the privacy of all occupants in the office, it is not appropriate to permit individual users to control the characteristics of the masking sound, which are relatively critical. Any temporal changes in the masking level throughout the office are seriously objectionable. Controls are typically locked by various security devices, including physical cabinet locks and electronic password controls to generators and other centrally located electronic components.

In addition to the conventional sound masking systems described above, several self-contained general-purpose devices have been used to provide masking sound in offices. These include mechanical devices using fans and various types of electronic sleep aids and "ambient nature environment" units. Although some of these devices have incorporated "white noise" generators, no one system is able to provide the three essential characteristics, for sound masking application, of tailored spectral shaping, adjustable level, and diffuse spatial quality.

BRIEF SUMMARY OF THE INVENTION

In accordance with the present invention, a personal sound masking system is disclosed that provides each individual workspace with an optimized acoustic background environment by delivering a sound masking signal that is specifically matched to the individual user's location and physical relationship to other nearby offices. The sound masking system employs multiple loudspeakers and multiple mutually incoherent channels in order to obtain a desired degree of diffuseness. In a preferred embodiment the sound masking signals are generated from a number of masking signal samples stored in a memory, and the samples are specifically synthesized to minimize memory requirements while avoiding audible transients or sample singularities.

The sound masking system also includes a conveniently accessible volume control to enable the user to adjust the sound level, in order to achieve optimum sound masking in his or her individual workspace.

The personal sound masking system of the invention is useful in any workspace or personal space where acoustic privacy from intruding background conversation is desirable. People occupying open office plan cubicles, occupants of closed offices or group work spaces, and residents of dormitory or hospital rooms can benefit from the optimized acoustic background environment possible with the system of the invention.

Other aspects, features, and advantages of the present invention are disclosed in the detailed description that follows.

DETAILED DESCRIPTION OF THE INVENTION

Figure 1:
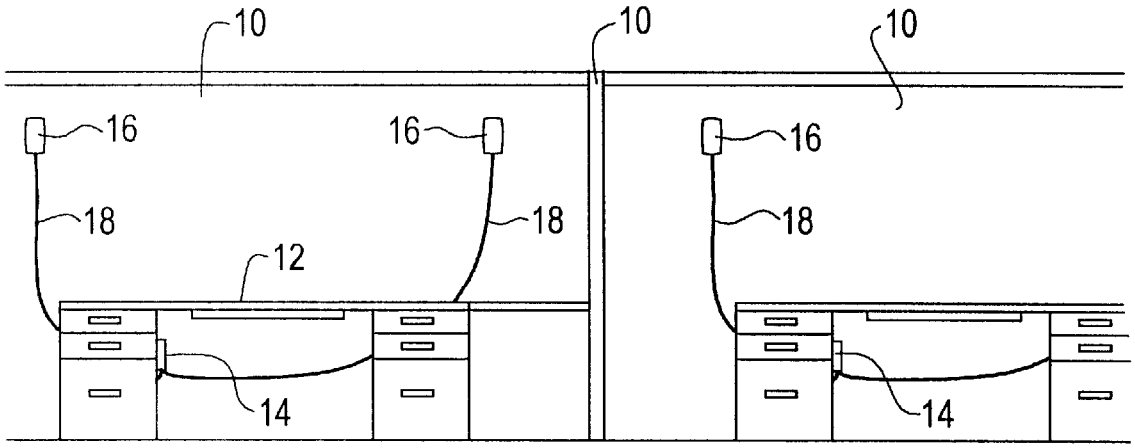
FIG. 1 is an elevation view of a personal sound masking system installed in an open plan office in accordance with the present invention.
Figure 2:
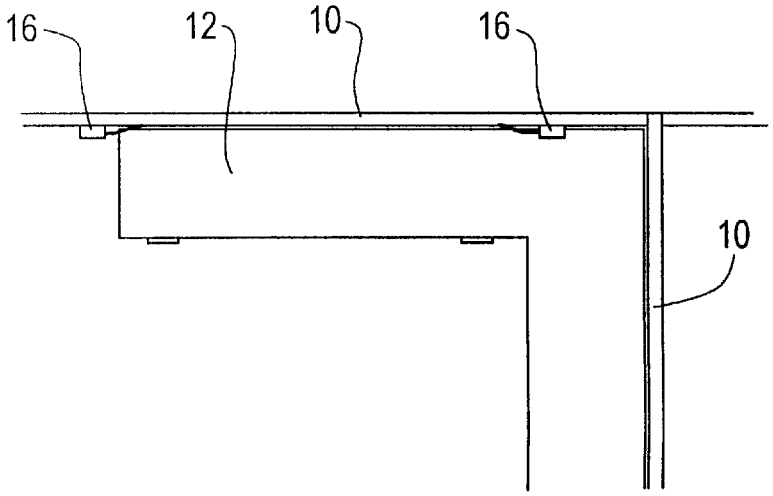
FIG. 2 is a plan view of the installation of FIG. 1.

FIGS. 1 and 2 show a typical open-plan office, often referred to as a "cubicle." The offices are separated by partitions 10 whose height is typically in the range of 4.5 to 7 feet. The office occupant may sit at a desk 12 or other station. A sound masking system includes a control module 14 mounted on an inside inner panel of the desk 12, using for example mating hook-and-pile tabs secured to the desk 12 and control module 14 respectively. The control module 14 is connected to left and right channel loudspeakers 16 via telephone-type multi-conductor cables 18. The loudspeakers 16 are secured to a partition 10 using suitable means, examples of which are described below.

Figure 3:
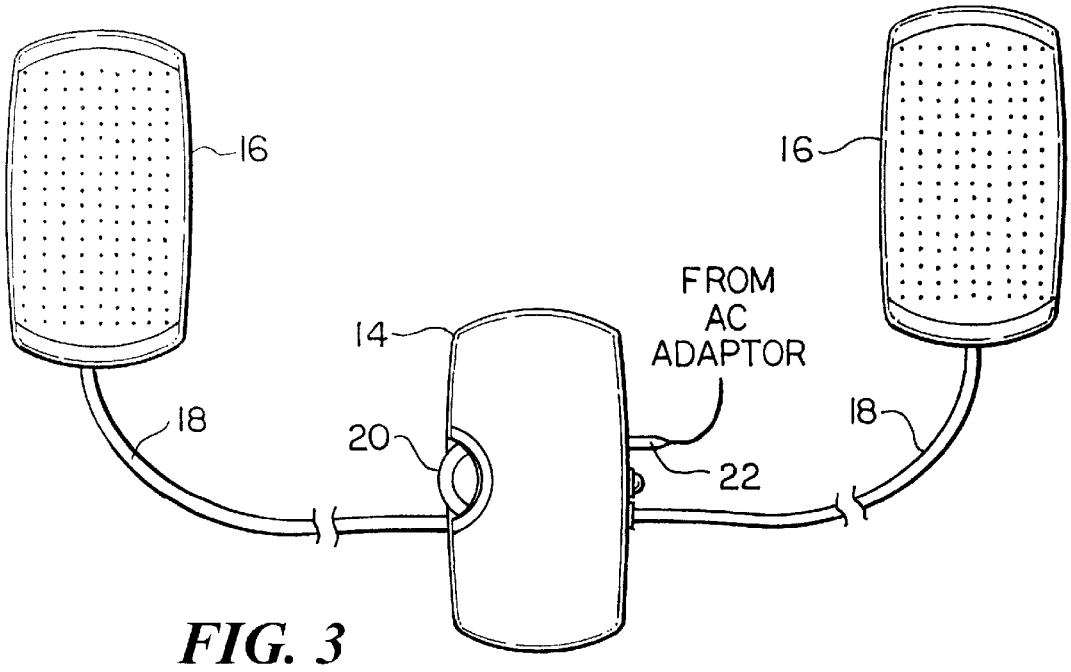
FIG. 3 is a system level assembly diagram of a personal sound masking system in accordance with the present invention.

FIG. 3 shows the elements of the personal sound masking system. The control module 14 has a user-accessible volume control 20. The loudspeaker cables 18 connect to the control module 14 using telephone-type modular plugs and jacks. The control module 14 also contains a jack for receiving a mating plug 22 of an external AC adapter that provides DC power at approximately 7 volts. It will be appreciated that in alternative embodiments DC power may be supplied at other convenient voltages.

Figure 4:
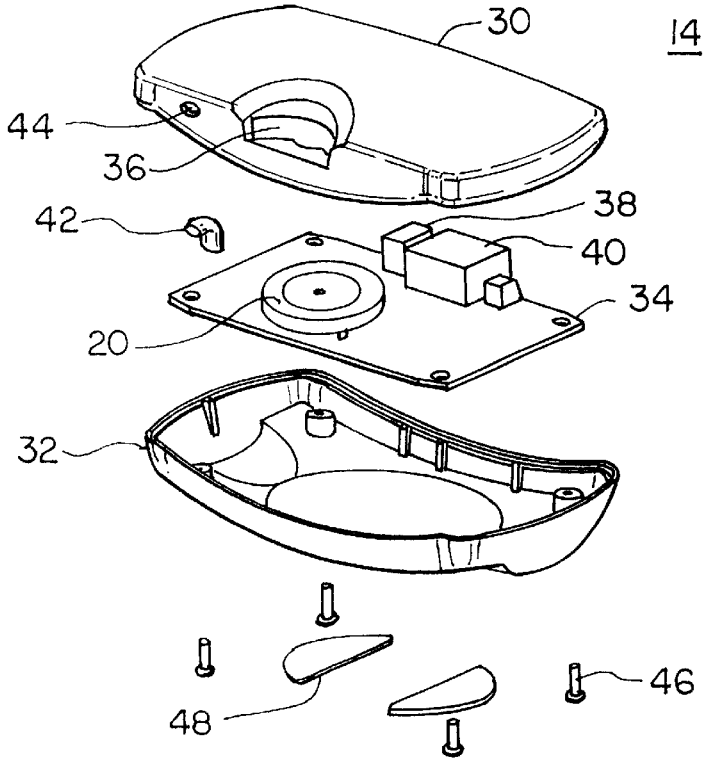
FIG. 4 is an exploded assembly diagram of a control module in the personal sound masking system of FIG. 3.

FIG. 4 shows the elements of the control module 14.

The control module 14 includes a top 30, base 32, and a printed circuit board (PCB) assembly 34 containing electronic circuitry that generates sound masking signals that are provided to the loudspeakers 16. The PCB assembly 34 includes the volume control 20, which extends through an opening 36 in the top 30 when the control module 14 is fully assembled. The PCB assembly 34 also includes a DC power jack 38 and dual modular jacks 40 for connection to the loudspeakers 16. A light pipe 42 is used to transmit an indication of the presence of DC power from the PCB assembly 34 to an external user via an opening 44 in the top 30. The top 30, base 32, and PCB assembly 34 are secured together using machine screws 46. Adhesive-backed hook-and-pile tab pairs 48 are secured to the outside of the base 32 for removably securing the control module 14 to a hard external surface.

Figure 5:
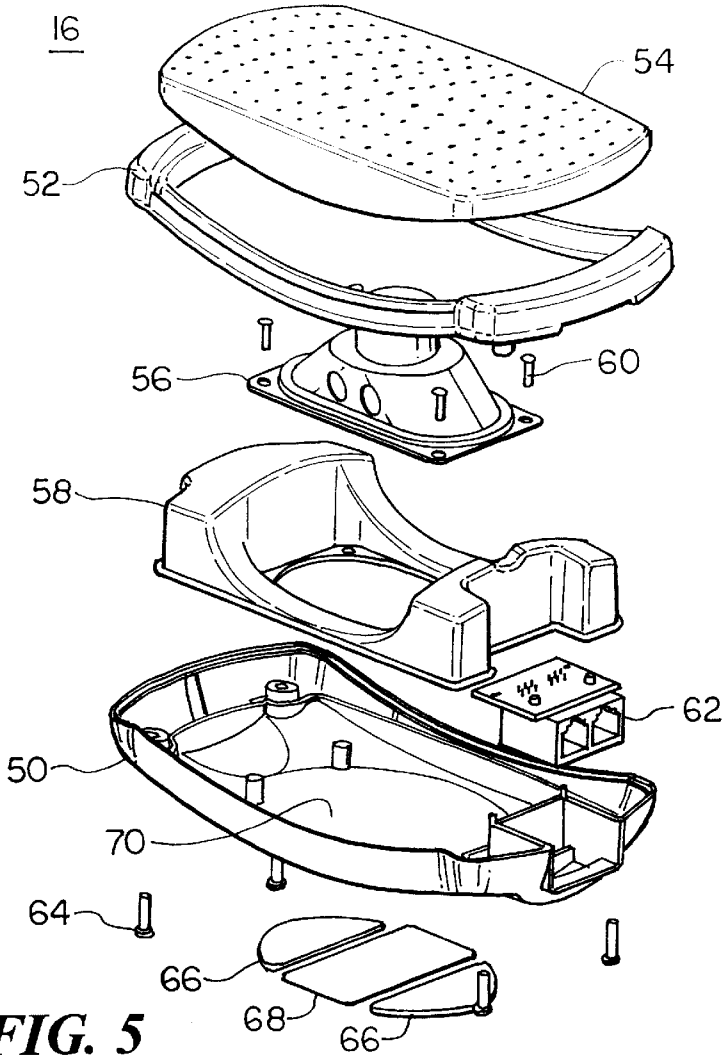
FIG. 5 is an exploded assembly diagram of a loudspeaker module in the personal sound masking system of FIG. 3.

FIG. 5 shows the elements of a loudspeaker module 16. The outer components include a base 50, a top 52, and a grill 54. A loudspeaker 56 is secured to an insert 58 using machine screws 60. The loudspeaker module 16 includes a dual modular jack component 62 connected to the loudspeaker 56 by wires (not shown). The various components of the loudspeaker module 16 are secured together using machine screws 64. Adhesive-backed hook-and-pile tab pairs 66 are secured to the outside of the base 50 for securing the loudspeaker module 16 to an external hard surface. An identifying label 68 is also secured to the outside of the base 50.

Notably, the loudspeaker 56 in the loudspeaker module 16 of FIG. 5 faces toward the base 50 rather than toward the grill 54. This arrangement is preferred in order to reduce an undesirable acoustical interference effect caused by loudspeaker placement relative to reflective surfaces. Sound radiated directly to a listener from a loudspeaker travels a shorter distance than is sound reflected from nearby surfaces. If the reflected sound path at a given frequency is ½ wavelength longer that the direct sound path, the reflected sound suffers a 180 degree relative phase shift and cancels the direct sound. Similarly if the reflected sound travels a full wavelength further than the direct sound, the reflected sound reinforces the direct sound, causing a peak in the response. Similar effects obtain at other even and odd multiples of ½ wavelength. These alternating dips and peaks, or comb filtering action, severely compromise the frequency response and cannot be effectively corrected by frequency equalization. However, if the radiating surface of the loudspeaker is close to the reflecting surface, this effect occurs at only short wavelengths or higher frequencies. Inverting the loudspeaker so that the distance from the loudspeaker cone to the reflecting surface is minimized moves the effect above the frequency range of interest.

Figure 6:
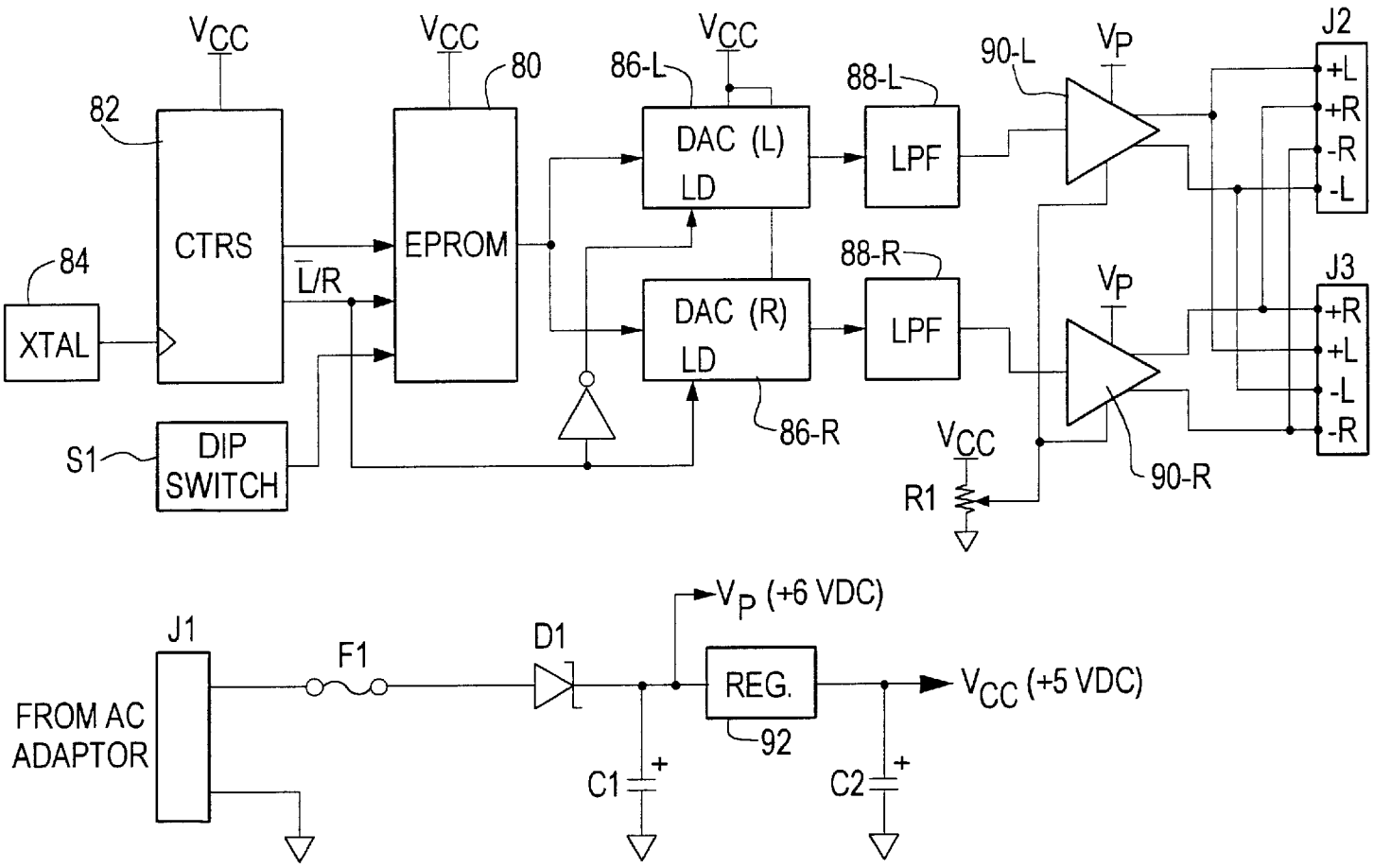
FIG. 6 is a schematic diagram of control circuitry on a printed circuit board in the control module of FIG. 4.

FIG. 6 shows the electrical circuitry employed on the PCB assembly 34 to generate the sound masking signals.

Data representing samples of left-channel and right-channel sound masking signals are stored in an erasable programmable read-only memory (EPROM) 80. The samples represent approximately 3 to 4 seconds of each signal, and are accessed in a repetitive fashion to continually reproduce the 3-to-4-second interval for each channel. The samples are created in a manner that minimizes audible transients or singularities that may be objectionable in the masking signal over numerous repetitions of the segment. In particular, the beginning and ending of each signal segment is located at a zero crossing in order to provide for a smooth transition between repetitions of the signal segment.

A set of counters 82 driven by a crystal oscillator 84 sequentially address the samples in a repetitive fashion to produce the masking signal for each channel. Alternating values generated by the counters 82 select samples from the left and right channels, and these values are loaded into a corresponding digital-to-analog converter (DAC) 86-L or 86-R. Low-pass filters 88-L and 88-R remove high frequency alias noise, and power amplifiers 90-L and 90-R amplify the signals to levels suitable for driving the respective loudspeakers 56 (FIG. 5). The gain of the amplifiers 90-L and 90-R is established by a control signal from a potentiometer Rl, which is part of the volume control 20 of FIGS. 3 and 4.

The outputs from the amplifiers 90-L and 90-R are provided to two modular jacks J2 and J3 in the manner shown. Because both the right and left channel signals are available at each jack J2 and J3, the control module 14 may be connected to the loudspeaker modules 16 in a variety of ways. For example, each loudspeaker module 16 may be connected to a different one of the jacks J2 and J3 with a separate cable 18, as shown in FIGS. 1 and 3. Alternatively, it may be desirable to use a "daisy chain" configuration, in which the control module 14 is connected to a first one of the loudspeaker modules 16 using one jack J2 or J3, and the first loudspeaker module 16 is then connected to the other loudspeaker module 16 in order to forward the corresponding masking signal. Such daisy chaining can also be used in an alternative embodiment having four independent channels rather than two. In such an embodiment, different pairs of loudspeakers are daisy-chained to a corresponding jack J2 or J3, and different pairs of four independent channels are connected to corresponding ones of the jacks.

FIG. 6 also shows power supply circuitry on the PCB assembly 34, including a jack J1 for receiving a plug from an AC adapter, a fuse F1, and a protection diode D1. The input power is filtered by capacitor C1 to provide a DC supply voltage Vp of approximately 6 volts. The supply Vp is used by the power amplifiers 90-L and 90-R as well as a 5-volt regulator 92. The output from the regulator 92 is a supply voltage Vcc filtered by a second capacitor C2.

While the illustrated embodiment does not include a power switch, it may be desirable to include a user-controlled ON/OFF switch in alternative embodiments.

Also shown in FIG. 6 is a dual inline package (DIP) switch S1 used to generate two additional address inputs for the EPROM 80. The switch S1 can be used to select from among four different sets of sound masking signals programmed into the EPROM 80. As discussed below, it may be desirable to provide sound masking signals having different spectra for use in different surroundings having different acoustic characteristics. By programming the different spectra into the EPROM 80 and providing a configuration switch S1, the sound masking system can be readily adapted for use in such different surroundings, while avoiding the need to maintain different versions of the system or version-specific components.

Figure 7:
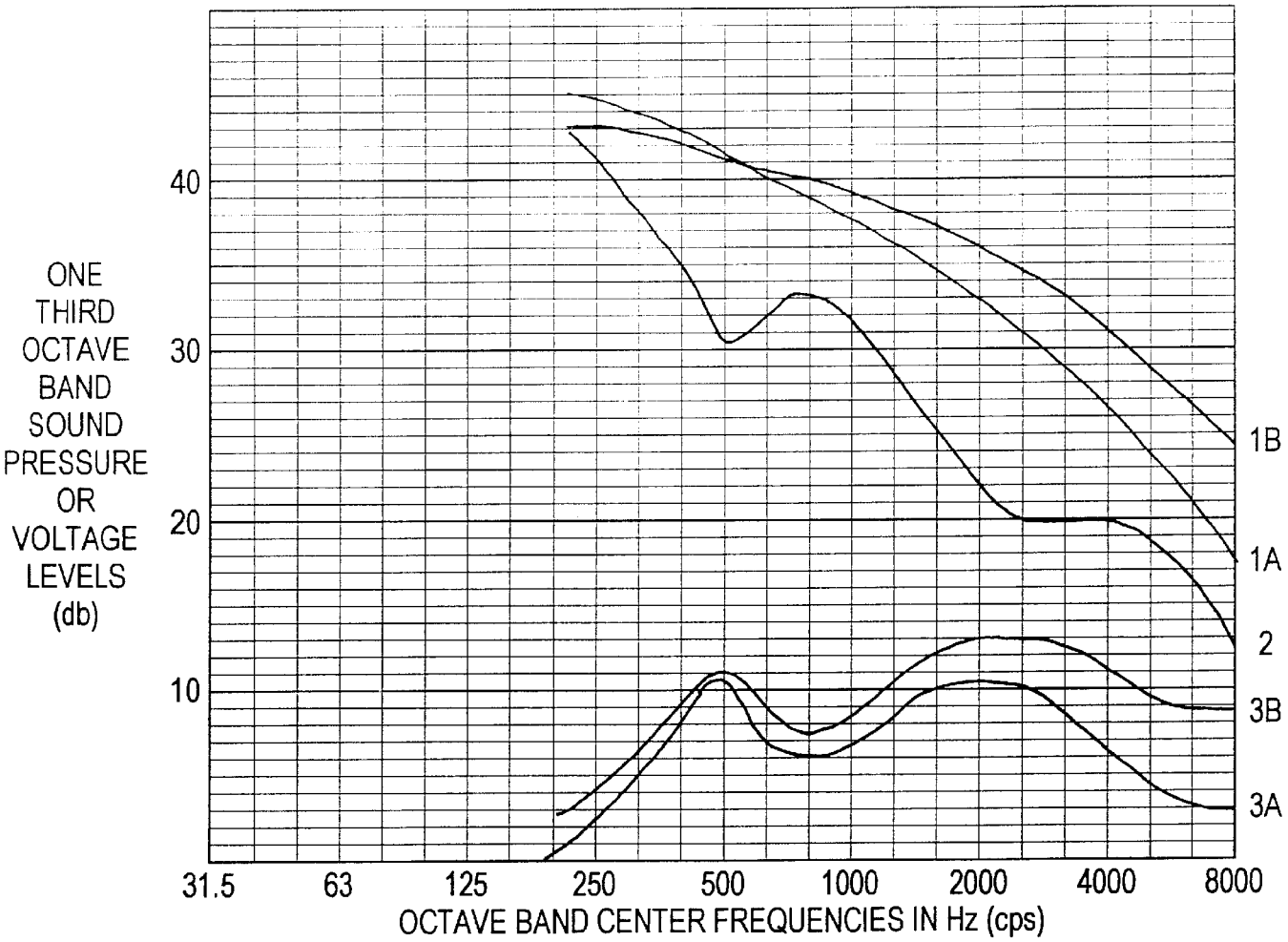
FIG. 7 is a plot of acoustic spectra of interest in the personal sound masking system of FIGS. 1–3.

FIG. 7 shows a plot of different spectra of interest in the personal sound masking system. The plotted values are sound pressure or loudspeaker terminal voltage levels, as appropriate, in ⅓-octave bands around corresponding center frequencies. Curve 1A represents a typical desired acoustical background spectrum for sound masking in an open plan type office, office "A," based on an articulation index of 0.20 and typical values of acoustical isolation between the office and an intruding source location, such as an adjacent office. Curve 2 represents the frequency response of the loudspeaker modules 16. Curve 3A is calculated as the difference between curves 1A and 2, and represents the required voltage spectrum generated by the control module 14 in order to achieve the background masking sound spectrum shown in curve 1A. It will be appreciated that the spectrum of curve 2 will generally be different in alternative embodiments employing different types or configurations of loudspeakers. It is generally desirable that the spectrum of curve 3A be matched to that of curve 2 so that the resulting background masking sound follows the spectrum of curve 1A.

Curve 1B represents a typical desired acoustical background spectrum for sound masking in another type of open office, office "B," having different ceiling materials and partition heights. Curve 3B illustrates the corresponding voltage spectrum required at the loudspeaker terminals assuming the same loudspeaker response as in case described above.

Figure 8:
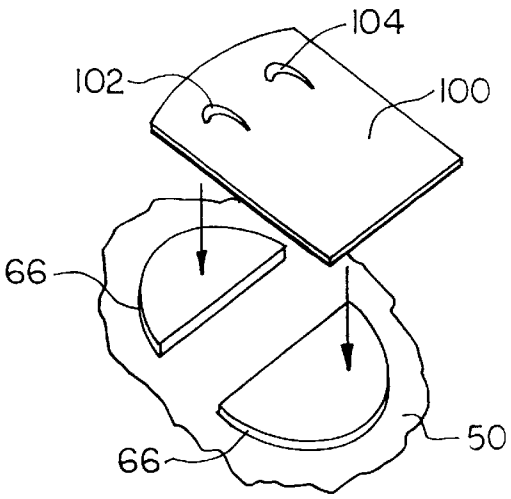
FIG. 8 illustrates an alternative mounting scheme for the loudspeaker module of FIG. 5.

FIG. 8 shows a technique for mounting each loudspeaker 16 to a cloth-covered surface, such as the wall of a typical open-plan office. A plastic pin plate 100 is secured to the adhesive-backed surface of the tab pairs 66. The pin plate 100 has embedded hooks 102 and 104 that taper to a point. The hooks 102 and 104 can be inserted into the cloth surface and then pressed downward to retain the loudspeaker on the wall.

While in the foregoing description the personal sound masking system includes two separate loudspeaker modules 16 and a separate control module 14, it may be desirable in alternative embodiments to integrate the PCB assembly 34 with one of the loudspeakers 56 in a combined control/loudspeaker module. Alternatively, to enhance portability the PCB assembly 34 and both loudspeakers 56 may be integrated into a single housing. As another variant, the loudspeaker modules 16 may be configured to be removably attachable to the control module 14 for enhanced portability, in a manner similar to portable stereo music systems or "boom boxes."

Regarding the signal-generating circuitry, it may be desirable that the memory used to store the signal samples be field programmable, for example to enable fast and cost-effective updating. Thus in alternative embodiments the EPROM 80 may be replaced by an electrically erasable device such as an EEPROM or a flash-programmable RAM.

In the illustrated embodiment the spectrum of the sound-masking signal is determined primarily by the collection of samples stored in a memory and sequentially played out via the DACs 86. It may be desirable in alternative embodiments to generate each masking signal using a cascaded circuit including a pseudo-random noise generator and a spectrum-shaping filter, where the noise generators for the different channels are mutually incoherent. The filters may be either digital or analog, and may include programmability features in order to provide flexibility in matching the spectra of the generated masking signals with the response of the loudspeaker modules.

In the foregoing, the sound masking system has been described as a distinct entity apart from other elements of a typical office. In alternative embodiments it may be desirable to integrate the sound masking function into another component, such as for example a multimedia personal computer (PC) used in the office. In such an embodiment the masking signal data may be recorded on a computer memory device such as a magnetic disk or optical disk, or it may be loaded into system memory from a network. Audio player software running in the background can play the masking signal through the PC's loudspeakers.

It will be apparent to those skilled in the art that modification to and variation of the above-described methods and apparatus are possible without departing from the inventive concepts disclosed herein. Accordingly, the invention should be viewed as limited solely by the scope and spirit of the appended claims.

What is claimed is:

1. A personal sound masking system, comprising:

two or more portable, separable loudspeakers configured for placement in an individual workspace subject to intruding sound;

a masking signal generator coupled to the loudspeakers, the masking signal generator being operative to generate two or more mutually-incoherent masking sound signals, the masking sound signals having spectra tailored to compensate for the frequency responses of the loudspeakers so that the background masking sound emitted by the loudspeakers has a desired spectrum in the individual workspace; and volume control apparatus coupled to the signal generator to enable a user of the sound masking system to individually control the volume of the background masking sound in the workspace to mask the intruding sound.

2. A personal sound masking system according to claim 1, wherein each loudspeaker is disposed in a corresponding loudspeaker enclosure having a front opening and a reflective interior rear surface, and wherein the loudspeaker faces rearward within the enclosure and is sufficiently close to the rear surface to substantially eliminate the effect of the reflected image of the loudspeaker on the spectrum of the sound field.

3. A personal sound masking system according to claim 1, wherein the masking signal generator comprises:

memory storing data representing samples of a short time segment of each masking signal, the collection of samples being sufficient to enable faithful reproduction of the masking signal segment therefrom;

addressing logic operative to access the samples stored in the memory in a sequential and repetitive fashion to generate two or more series of data values, each series representing a corresponding different one of the masking signals;

digital to analog conversion circuitry operative to convert each series of samples into a corresponding analog masking signal; and power amplification circuitry operative to amplify the masking signals generated by the digital to analog conversion circuitry to levels suitable for driving the loudspeakers.

4. A personal sound masking system according to claim 3, wherein the memory comprises an erasable programmable read only memory (EPROM) in which the samples are stored.

5. A personal sound masking system according to claim 3, wherein: (i) the memory includes a single memory device in which the samples for all of the masking signals are stored, (ii) the single memory device has one set of address inputs and one set of data outputs via which samples of any of the masking signals are obtained, and (iii) the addressing logic is operative to alternate among samples of different masking signals so as to simultaneously generate the series of data values for the different masking signals.

6. A personal sound masking system according to claim 1, wherein the masking signal generator and volume control apparatus are disposed in a portable common housing.

7. A personal sound masking system according to claim 6, further comprising:

a regulator operative to receive DC power at a first voltage and to provide DC power at a second voltage to the masking signal generator; and a jack disposed on the common housing and connected to the regulator, the jack being operative to receive a plug from an external DC power supply and to transfer DC power from the external DC power supply to the regulator.

8. A personal sound masking system according to claim 1, wherein the individual workspace is a first type of workspace and the two or more mutually-incoherent masking sound signals are part of a first set of masking sound signals capable of being selectively generated by the masking signal generator, and wherein the masking signal generator is further operative to selectively generate one or more additional different sets of masking sound signals, each set of masking sound signals having spectra tailored so that the background masking sound emitted by the loudspeakers has a desired spectrum in other types of workspaces having different values of acoustical isolation between workspaces.

9. A personal sound masking system according to claim 1, wherein the loudspeakers are daisy-chained with a single cable type automatically providing alternating connections to different incoherent signal channels.

* * * * *